US006929213B1

(12) United States Patent
Contreras

(10) Patent No.: US 6,929,213 B1
(45) Date of Patent: Aug. 16, 2005

(54) ROLL DISPENSER

(76) Inventor: Emiliano Contreras, 4136 Russell Rd., P.O. Box 523, Suisun, CA (US) 94585

( * ) Notice: Subject to any disclaimer, the term of this patent is extended or adjusted under 35 U.S.C. 154(b) by 0 days.

(21) Appl. No.: 10/431,106

(22) Filed: May 6, 2003

Related U.S. Application Data

(60) Provisional application No. 60/382,736, filed on May 23, 2002.

(51) Int. Cl.[7] ..... B65H 75/32; B26F 3/02

(52) U.S. Cl. ..... 242/598.3; 242/598.5; 225/80

(58) Field of Search ..... 242/597.7, 597.1, 242/597.4, 597.8, 598.5, 598.3, 588.4, 588.6, 242/596.8, 423, 423.1; D6/522; 206/225, 206/389, 391, 407, 409; 225/39, 42, 46, 80, 225/106

(56) References Cited

U.S. PATENT DOCUMENTS

| | | | | | |
|---|---|---|---|---|---|
| 452,719 | A | * | 5/1891 | Ross | |
| 2,303,173 | A | * | 11/1942 | Roehrl | |
| 2,475,882 | A | * | 7/1949 | De Capite | 242/598.5 |
| 3,413,049 | A | * | 11/1968 | Smay | 242/596.8 |
| 3,698,548 | A | * | 10/1972 | Stenzel et al. | 242/588.4 |
| 4,272,035 | A | * | 6/1981 | Sherman et al. | 242/596.8 |
| 4,369,929 | A | * | 1/1983 | Cayer | 242/423.1 |
| 4,487,376 | A | * | 12/1984 | Compton | 242/423.1 |
| 4,738,385 | A | * | 4/1988 | Bell | 242/423.1 |
| 4,936,452 | A | * | 6/1990 | Pauley | 242/588.6 |
| 5,038,934 | A | * | 8/1991 | Higashiyama | |
| 5,598,987 | A | * | 2/1997 | Wachowicz | 242/597.8 |
| 5,763,984 | A | * | 6/1998 | Day | 242/596.8 |
| 6,161,796 | A | * | 12/2000 | Daniels | 242/597.7 |
| 6,189,828 | B1 | * | 2/2001 | Reilly | |
| 6,267,322 | B1 | * | 7/2001 | Harmathy | |
| 6,478,246 | B2 | * | 11/2002 | Fahringer | |

FOREIGN PATENT DOCUMENTS

| | | | |
|---|---|---|---|
| EP | 0 089 933 | * | 9/1983 |

* cited by examiner

*Primary Examiner*—William A. Rivera
(74) *Attorney, Agent, or Firm*—Jack Lo

(57) ABSTRACT

A roll dispenser is comprised of a tubular housing with a first end cap and a second end cap. Each end cap is comprised of a plate with an integral lip which is parallel to the sides of the housing for a slide fit. The first end cap is removable from the housing. A longitudinal slot is arranged along the housing. Slots in respective lips of the end caps are aligned with the slot in the housing. A rod has a second end attached to the inside of the second end cap in a coaxial position inside the housing. A ring attached to the inside of the first end cap is arranged to support a first end of the rod. A mounting block is attached to a side of the housing. A mounting bracket is detachably mated with the mounting block for mounting the dispenser on a wall.

2 Claims, 7 Drawing Sheets

ROLL DISPENSER

CROSS REFERENCE TO RELATED APPLICATIONS

I claim the benefit of provisional application No. 60/382,736 filed on May 23, 2002.

BACKGROUND OF THE INVENTION

1. Field of the Invention

The invention broadly relates to rolled sheet dispensers.

2. Prior Art

Rolls of household sheet materials such as paper towels and plastic wrap are typically placed in dispensers. A paper towel dispenser is typically comprised of a vertical rod attached to base. A roll of paper towel is slid onto the rod to be gradually unrolled. When removing a sheet of paper towel, most people pull out a sheet with one hand, hold the roll with the other hand, and tear off the sheet. A person who needs to use a paper towel often has hands covered in food, grease, dirt, etc. Grabbing the roll of paper towel during dispensing often makes the roll dirty. Further, the sheet is sometimes ripped at an angle instead of along the perforation.

A roll of plastic wrap is typically sold in a lightweight cardboard container with a built-in cutting blade. The container is thus also a dispenser. When removing a sheet of plastic wrap, the dispenser is held in one hand, and the sheet is pulled out and torn off with the other hand. A person who has been cooking often makes the dispenser dirty by grabbing it during dispensing. Further, the cardboard box is opaque, so that the remaining amount of sheet material cannot be seen.

BRIEF SUMMARY OF THE INVENTION

Object of the present roll dispenser are:

to receive a roll of sheet material;

to protect the sheet material from contamination;

to dispenser the sheet material;

to cleanly sever the sheet material along a straight edge; and to enable dispensing without touching the dispenser.

The present roll dispenser is comprised of a tubular housing with a first end cap and a second end cap. Each end cap is comprised of a plate with an integral lip which is parallel to the sides of the housing for a slide fit. The first end cap is removable from the housing. A longitudinal slot is arranged along the housing. Slots in respective lips of the end caps are aligned with the slot in the housing. A rod has a second end attached to the inside of the second end cap in a coaxial position inside the housing. A ring attached to the inside of the first end cap is arranged to support a first end of the rod. A mounting block is attached to a side of the housing. A mounting bracket is detachably mated with the mounting block for mounting the dispenser on a wall.

A second embodiment includes a rod inside the housing, and a threaded shaft connected between the rod and a knob on top of a first end cap. The knob is turned to adjust pressure on the roll of sheet material.

A third embodiment includes a housing comprised of upper and lower housings. A slit is arranged between the upper and lower housings. A blade is supported adjacent the slit by arms extending from the housing. A bar is connected between the arms slightly higher than the blade to protect the user from blade.

DRAWING REFERENCE NUMERALS

| | |
|---|---|
| 10. Housing | 11. First End Cap |
| 12. Second End Cap | 13. Plate |
| 14. Lip | 15. Plate |
| 16. Lip | 17. Slot |
| 18. Slot | 19. Slot |
| 20. Rod | 21. Second End |
| 22. Ring | 23. First End |
| 24. Mounting Block | 25. Mounting Bracket |
| 26. Plate | 27. Arm |
| 28. Hole | 29. Roll |
| 30. Core | 31. End of Roll |
| 40. Housing | 41. End |
| 42. Lower Housing | 43. Upper Housing |
| 44. Rear Side | 45. Rod |
| 46. Bracket | 47. Slot |
| 48. Blade | 49. Arm |
| 50. Bar | 51. Cutting Edge |
| 52. Roll | 53. Core |
| 54. End of Roll | 55. Housing |
| 56. First End Cap | 57. Second End Cap |
| 58. Roll of Sheet Material | 59. Rod |
| 60. Core | 61. Threaded Shaft |
| 62. Knob | 63. Spring |
| 64. Shoulder | |

DETAILED DESCRIPTION OF THE INVENTION

Figure 1:
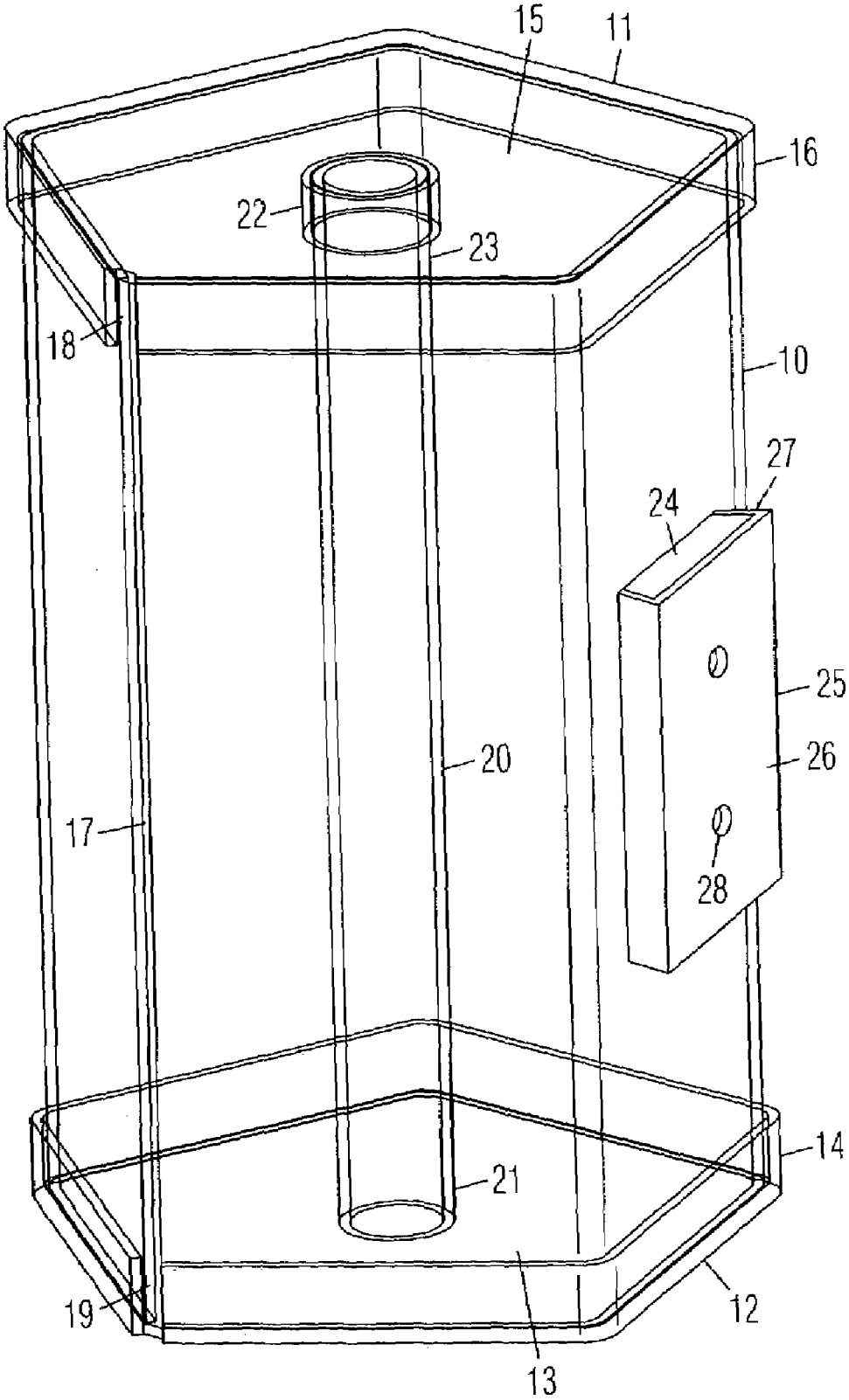
FIG. 1 is a side perspective view of a first embodiment of the present roll dispenser.

FIG. 1:

A first embodiment of the present roll dispenser is shown in a side perspective view in FIG. 1. It is comprised of a tubular housing 10 with a first end cap 11 and a second end cap 12. In the example shown, housing 10 and end caps 11 and 12 are transparent, but they may be opaque. Housing 10 is pentagonal in cross section, but it may be of any other shape. Second end cap 12 is preferably comprised of a plate 13 with an integral lip 14 which is parallel to housing 10 for a slide fit. Lip 14 may be on the outside of housing 10 as shown, or it may be on the inside. Alternatively, lip 14 may be eliminated and second end cap 12 may be fixedly attached to housing 10. First end cap 11 is preferably comprised of a 15 plate with an integral lip 16 which is parallel to housing 10 for a slide fit. Lip 16 may be on the outside of housing 10 as shown, or it may be on the inside. First end cap 11 is removable from housing 10. A longitudinal slot 17 is arranged along housing 10. Slots 18 and 19 in respective lips 14 and 16 of end caps 11 and 12 are aligned with slot 17 in housing 10. A rod 20 has a second end 21 attached to the inside of second end cap 12 in a coaxial position inside housing 10. A ring 22 attached to the inside of first end cap 11 is arranged to support a first end 23 of rod 20. A mounting block 24 is attached to a side of housing 10. Mounting block 24 is preferably straight longitudinally, and flared at its outer end. A mounting bracket 25 is detachably mated with mounting block 24. Mounting bracket 25 is preferably comprised of a plate 26 with inwardly angled arms 27 at opposite edges for gripping the sides of mounting block 24. Screw holes 28 on plate 26 enable mounting bracket 25 to be attached to a wall. Alternatively, another mounting mechanism may be provided.

Figure 2:
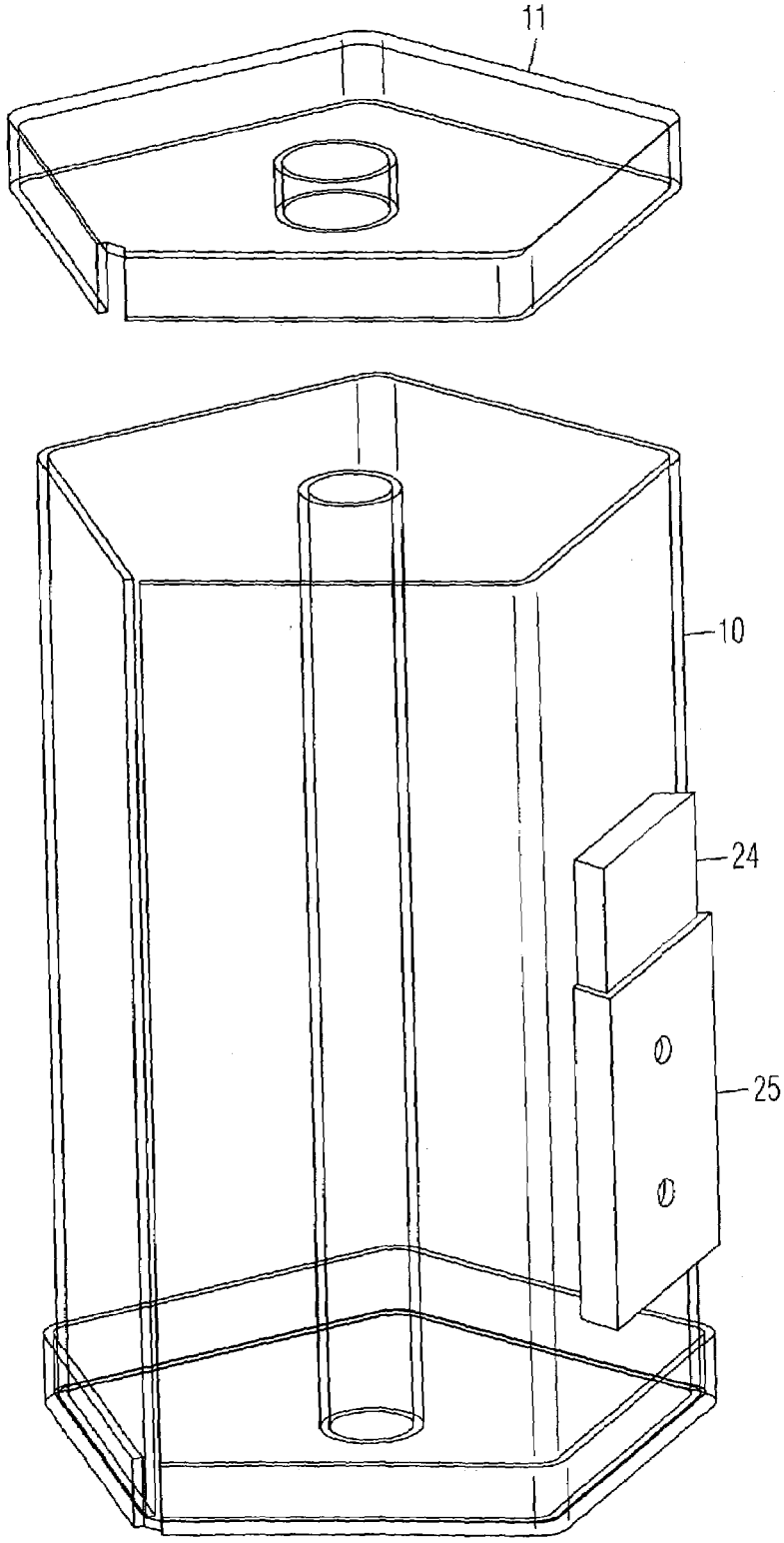
FIG. 2. is an exploded view thereof.

FIG. 2:

In FIG. 2, first end cap 11 is removed from housing 10, and mounting bracket 25 is partially slid away from mounting block 24 to show the detachable parts of the roll dispenser. When first end cap 11 is removed, a roll of sheet material may be installed inside housing.

Figure 3:
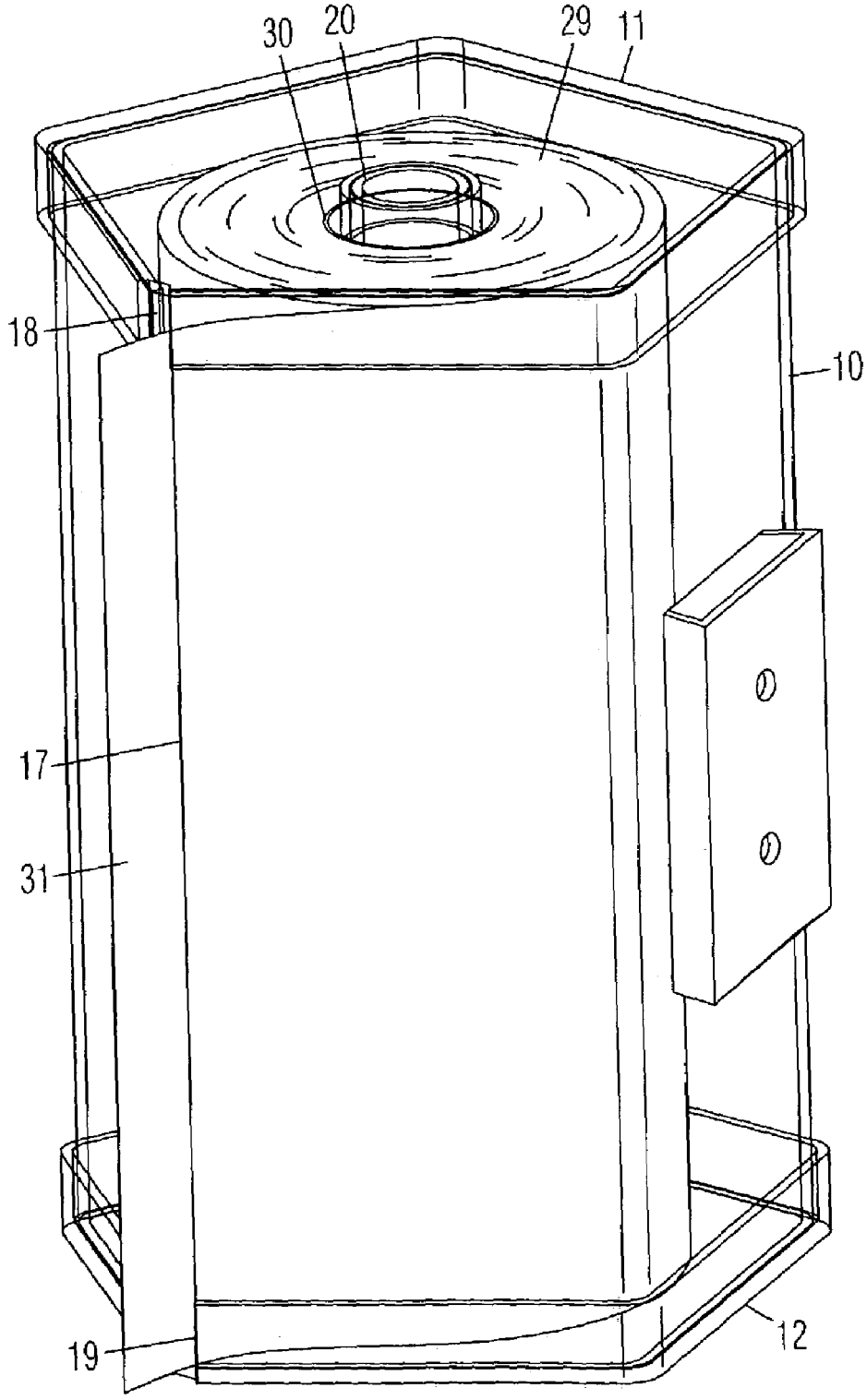
FIG. 3 is a side perspective view thereof with a roll of sheet material installed.

FIG. 3:

In FIG. 3, a roll of sheet material 29, such as paper towel, is received in housing 10. Roll 29 is visible through transparent housing 10 and end caps 11 and 12 for viewing the available amount of material. Rod 20 is positioned inside a tubular core 30 of roll 29 and functions as an axle for roll 29 when it is rotated. An end of roll 29 is positioned through slots 17–19 in housing 10 and caps 11 and 12. Roll 29 is completely enclosed and protected from contaminants by the roll dispenser.

Figure 4:
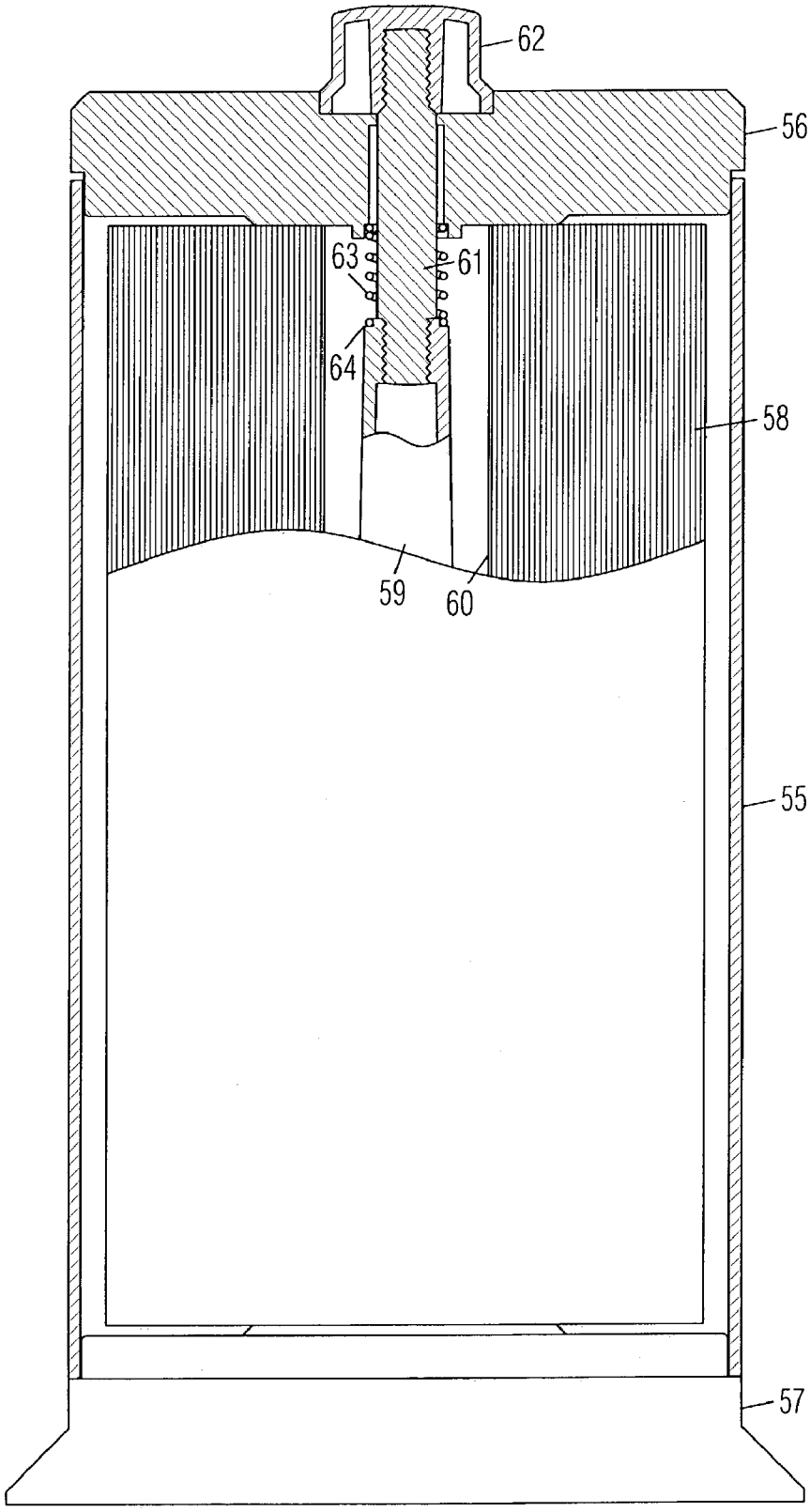
FIG. 4 is a partial sectional view of a second embodiment thereof.

FIG. 4:

A second embodiment of the roll dispenser is shown in a partial sectional view in FIG. 4. It is comprised of a tubular housing 55 with first and second end caps 56 and 57 at opposite ends. Second end cap 57 is fixed to housing 55. First end cap 56 is removable from housing 55 for inserting a roll of sheet material 58, such as a roll of paper towel. A rod 59 is positioned within housing 55 and connected to second end cap 57 for being positioned inside a core 60 of roll of sheet material 58. A threaded shaft 61 has an inner end connected to rod 59, and an outer end positioned through first end cap 56 and connected to a knob 62 positioned against the outside of first end cap 56. A coil spring 63 is positioned between a shoulder 64 of rod 59 and an inner end of first end cap 56. Knob 62 is turned to apply a desired amount pressure against roll of sheet material 58 to avoid spinning it when a sheet is torn off through a slit (not shown) on housing 55.

Figure 5:
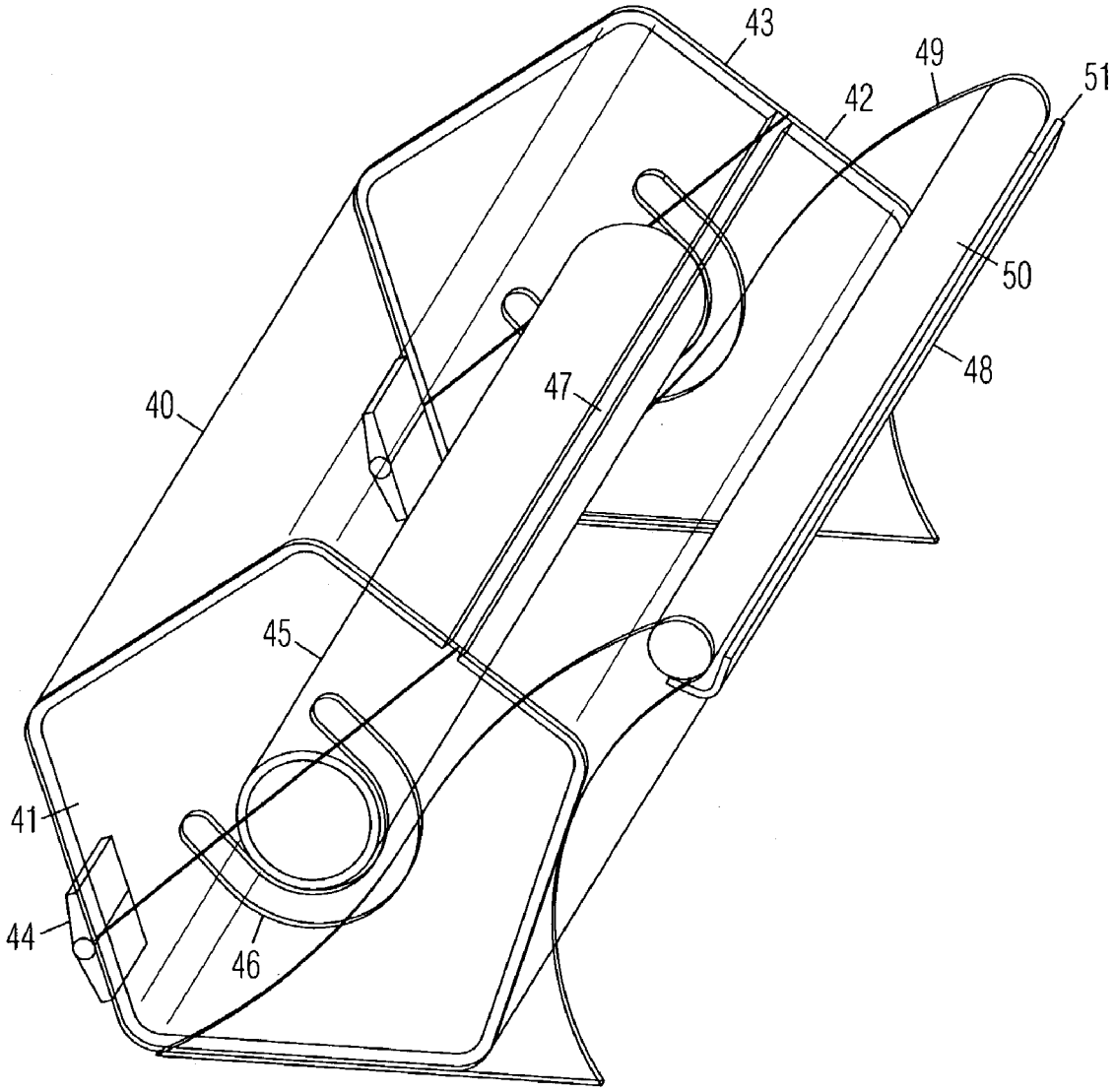
FIG. 5 is an end perspective view of a third embodiment thereof.

FIG. 5:

A third embodiment of the roll dispenser is shown in FIG. 5. It is comprised of a tubular housing 40 with end caps 41, which are preferably transparent. Housing 40 is pentagonal in cross section in this example, but it may be of any other shape. Housing 40 is divided into a lower housing 42 and an upper housing 43 connected by hinges on a rear side 44. A rod 45 is supported longitudinally inside housing 40 by a pair of brackets 46 attached to end caps 41. A longitudinal slot 47 is arranged along a front side of housing 40. Slot 47 is preferably comprised of a gap between the adjacent edges of lower and upper housing portions 42 and 43. A longitudinal blade 48 is supported in front of slot 47 by arms 49 extending from housing 40. A bar 50 is supported by arms 49 between blade 48 and slot 47. A top of bar 50 is positioned higher than a cutting edge 51 of blade 48 to protect the user from blade 48.

Figure 6:
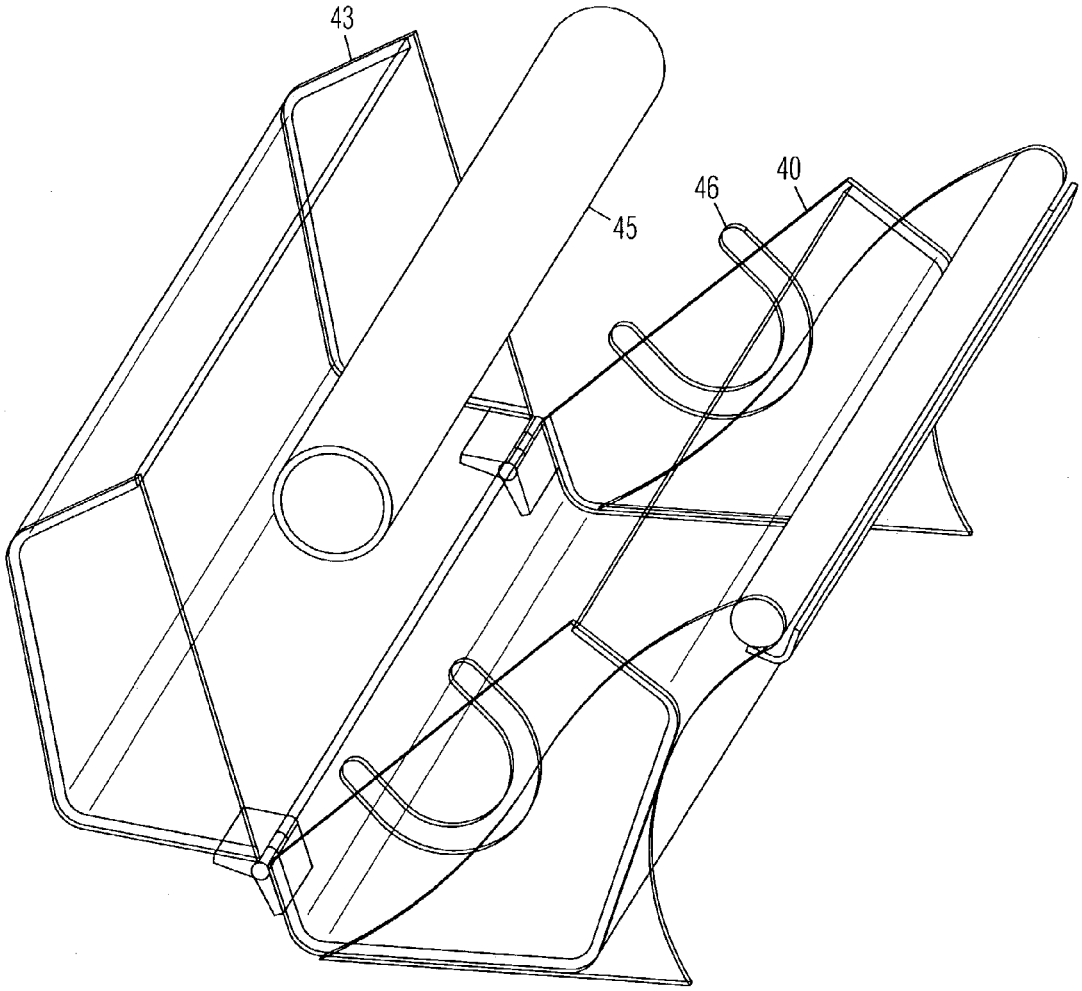
FIG. 6 is an exploded view of the third embodiment.

FIG. 6:

In FIG. 6, upper housing 43 is pivoted open and rod 45 is removed from brackets 46 to show the detachable parts of the roll dispenser. When upper housing portion 43 is opened, a roll of sheet material may be installed inside housing 40.

Figure 7:
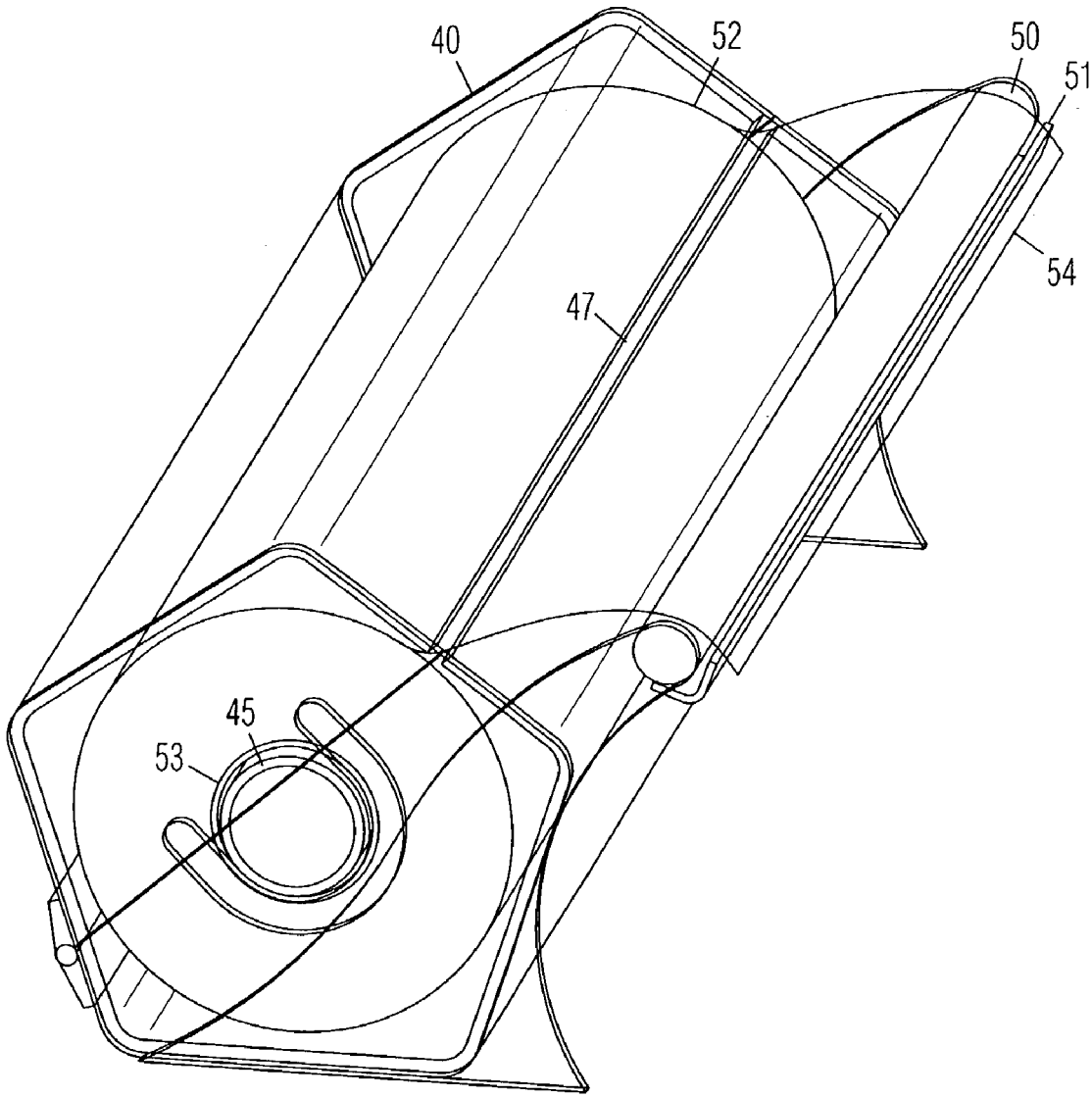
FIG. 7 is an end perspective view of the third embodiment with a roll of sheet material installed.

FIG. 7:

In FIG. 7, a roll of sheet material 52, such as plastic food wrap, is received in housing 40. Rod 45 is positioned inside a tubular core 53 of roll 52 and functions as an axle for roll 52 when it is rotated. An end 54 of roll 52 is positioned through slot 47 in housing 40. Roll 52 is completely enclosed and protected from contaminants by the roll dispenser. End 54 of roll 52 is draped over bar 50 and pulled down on blade 48 for cutting.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A roll dispenser, comprising:

a tubular housing for receiving a roll of sheet material;

a rod supported longitudinally inside said housing for being positioned inside said roll of sheet material;

a longitudinal slot arranged along a front side of said housing for dispensing said sheet material;

a longitudinal blade supported in front of said slot by a pair of arms extending from said housing for cutting said sheet material; and a bar supported by said arms between said blade and said slot, wherein a top of said bar is positioned higher than a cutting edge of said blade for protecting a user from being cut by said blade.

2. A roll dispenser, comprising:

a tubular housing for receiving a roll of sheet material, wherein said housing is divided into a lower housing and an upper housing connected by a hinge on a rear side of said housing;

a rod supported longitudinally inside said housing for being positioned inside said roll of sheet material;

a longitudinal slot arranged along a front side of said housing for dispensing said sheet material, wherein said slot is comprised of a gap between adjacent edges of said lower housing and said upper housing;

a longitudinal blade supported in front of said slot by a pair of arms extending from said housing; and a bar supported by said arms between said blade and said slot, wherein a top of said bar is positioned higher than a cutting edge of said blade for protecting a user from being cut by said blade.

* * * * *